United States Patent [19]

Yoshii et al.

[11] 4,358,313

[45] Nov. 9, 1982

[54] PROCESS FOR REFINING MOLTEN PIG IRON AND STEEL

[75] Inventors: Masataka Yoshii; Mitsugu Anabuki; Tatsuro Kuwabara; Yasuo Obana; Takuo Kóno, all of Oita, Japan

[73] Assignee: Nippon Steel Corporation, Tokyo, Japan

[21] Appl. No.: 244,116

[22] Filed: Mar. 16, 1981

[30] Foreign Application Priority Data

Mar. 17, 1980 [JP] Japan ..... 55-33546

[51] Int. Cl.[3] ..... C21C 1/00

[52] U.S. Cl. ..... 75/60; 75/49; 75/129; 75/130 R; 75/130.5

[58] Field of Search ..... 75/60, 49, 129, 130 R, 75/130.5

[56] References Cited

U.S. PATENT DOCUMENTS 3,336,132 8/1967 McCoy ..... 75/130.5

3,607,247 9/1971 McCoy ..... 75/60

*Primary Examiner*—P. D. Rosenberg

*Attorney, Agent, or Firm*—Cushman, Darby & Cushman

[57] ABSTRACT

Refining of molten pig iron and steel in a converter by oxygen blowing continuously at least four charges in a converter to a carbon content in a range from 0.09 to 0.15% and further subjecting the molten steel to a secondary refining by addition or removal of carbon.

8 Claims, 7 Drawing Figures

PROCESS FOR REFINING MOLTEN PIG IRON AND STEEL

BACKGROUND OF THE INVENTION

1. Field of the Invention

The present invention relates to a process for refining molten pig iron and steel, which process combines a converter refining step and a secondary refining step so as to remarkably enhance the all-round economy of the process.

2. Description of Prior Arts

In recent years the most predominant process for iron and steel making has been the blast furnace-converter process, and the principal refining ability attributed to the converter in this process is removal of carbon and phosphorus from liquid blast-furnace iron.

According to the conventional converter process which has been commonly adopted for steel making, the so-called catch-carbon method is used, which method comprises varying the predetermined blown-off carbon [C] content in correspondence to the predetermined carbon [C] content to be achieved in the final product by the process and changing the oxygen blowing condition accordingly.

The variation in the blown-off carbon content from charge to charge causes necessarily considerable fluctuation of (FeO) content in the slag, which in turn produces substantial influences on the phosphorus removing ability of the slag. For this reason, such an oxygen blowing method has been conventionally practised as to increase the (FeO) content in the slag so as to obtain a blown-off phosphorus [P] content which satisfies the standard specification of the phosphorus content in the final product. However, such changes in the operational conditions from charge to charge and the operation under the high-(FeO) slag as above inevitably result in a metallurgical operation susceptible to substantial fluctuations in various operational conditions, thus lowering the reproductibility of desired operational conditions, and causing in the last an unstable operation and an increased operation cost.

In order to eliminate the above difficulties and disadvantages, the so-called dynamic control method has been developed as an effective means for controlling the conventional operation susceptible to the substantial fluctuations. According to this method, the bath composition and temperature are measured in the course of oxygen blowing and the blowing trend is revised and adjusted on the basis of the intermediate measurements. This method, however, has been found in practical operations to be unable to maintain the simultaneous achievement of a desired blown-off carbon [C] content and a desired blown-off temperature at an achievement ratio of 80% or higher, and to maintain the ratio of required reblowing at 10% or lower.

SUMMARY OF THE INVENTION

Therefore, one of the objects of the present invention is to eliminate the above defects and disadvantages of the conventional arts and to provide a process for refining molten pig iron and steel, in which the converter process is directly connected to the secondary refining process so as to develop maximum advantages of individual processes so as to substantially reduce the operational load exposed on the converter operation and reasonably lower the total operational cost.

The process according to the present invention comprises continuously treating at least four charges in a converter and continuously tapping therefrom a molten steel with a blown-off carbon content ranging from 0.09 to 0.15%[C], and adjusting the carbon content in the molten steel by addition or removal of carbon in a secondary refining process to a predetermined carbon content for final products.

According to an embodiment of the present invention, the oxygen blowing is stopped at a bath temperature ranging from 1600° to 1640° C., and the molten steel tapped from the converter is reheated or cooled to adjust the casting temperature.

According to another embodiment of the present invention, the variation in the value of (silicon [Si]% in the pig)×(hot metal ratio) is maintained within ±10, the variation in amounts of auxiliary materials is maintained within ±5%, and the auxiliary material is charged at a substantially same stage in each oxygen blowing.

According to still another embodiment of the present invention, at least 5 kg per ton of pig iron of Fe-Mn ore is added to the molten steel in the converter.

The term "blown-off" used in the present invention means "at the end point of the oxygen blowing" and [ ] and ( ) mean "in the pig iron or steel" and "in the slag", respectively.

DETAILED DESCRIPTION OF THE INVENTION

The present invention will be described in details with reference to the attached drawings.

Figure 1:
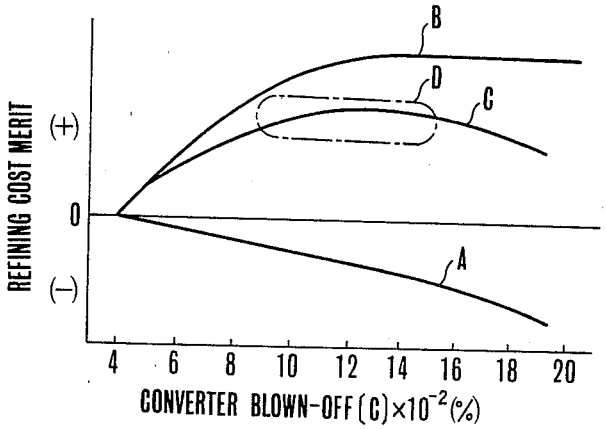
FIG. 1 shows the relation between the blown-off carbon [C] contents and the refining cost in a converter-RH process.
Figure 2:
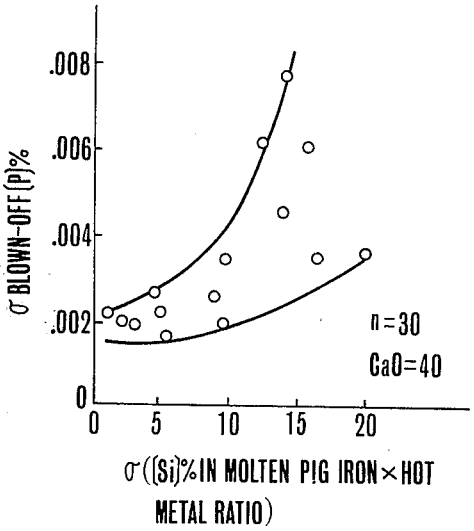
FIG. 2 shows the relation between variations in the index $\alpha$ of Si amount charged to the converter ([Si]% in the molten pig iron×the hot metal ratio) and the blown-off phosphorus [P] percent.

The basic technical thought of the present invention is shown in FIG. 1, in which the horizontal axis represents the blown-off carbon [C] content level in the steel when the blowing of the converter is stopped, the vertical axis represents the relative refining costs of molten pig iron and steel so as to determine the most economical and reasonable operation zone, and the line A represents the relation therebetween in the secondary refining step, such as a degassing treatment, the line B represents the similar relation in the converter blowing step, and the line C represents the similar relation in the over-all refining process combining the lines A and B. The present invention provides a method which can realize a consistent commercial operation in the higher zone D of the line C, thus enhancing the over-all operational efficiency. For maximizing the higher zone D, the converter blowing must be performed in such a way that the (FeO) content in the slag is controlled to the lowest level as possible while the blown-off phosphorus [P] content is controlled in a range which satisfies a standard specification of the final product, thus reducing causes of the variation in the blowing conditions, such as the reblowing ratio. In this way, remarkable advantages including:

(1) Improvement of yield of refined steel.
(2) Elongation of life of refractories used in the converter as well as in molten steel handling vessels.
(3) Lowering of amounts of alloying elements required per unit ton of refined steel.

can be achieved so that the over-all economical efficiency can be remarkably enhanced.

For achieving the above advantages consistently, it is desirable to establish the following procedures.

1. The mixing condition of the main materials and auxiliary materials to be charged to the converter, and the timing for charging these materials are made consistent and also the slag formation condition as well as the blown-off temperature is made consistent so as to reduce the variation in the blown-off phosphorus [P] content.

2. At the initial and middle stages of blowing, Fe-Mn ore is added to promote early slag formation and dephosphorization, and stabilize the blown-off manganese [Mn] content at a high level by means of the procedure 3.

3. The blown-off carbon [C] content is set at a constant value in the high carbon zone, so as to stabilize the blown-off (FeO) content in the slag at a lower level.

4. After the tapping from the converter, the carbon [C] content is finely adjusted by adding or removing the carbon in a secondary refining vessel, such as a RH vacuum degassing vessel, provided with an oxygen blowing device.

The above described operational conditions are basic for consistently obtaining the desired objects of the present invention. Detailed descriptions of each operational condition will be made below.

1. Consistency of conditions of materials to be charged in the converter.

In order to keep the oxidation heat generation in the converter in a constant range and to reduce the variation in the amount of $SiO_2$ which is a main slag-forming component, the absolute amount of [Si] to be introduced into the converter is kept in a certain range.

Figure 3:
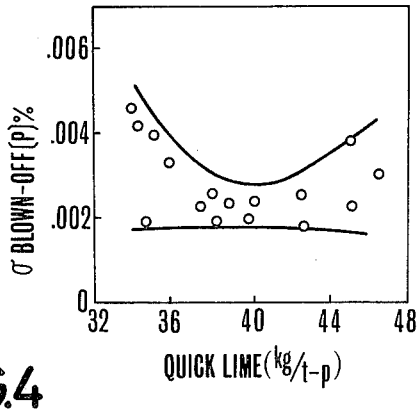
FIG. 3 shows the relation between the required amount of quick lime and variation in the blown-off phosphorus [P] percent when the index of Si amount charged to the converter is from 35 to 40 kg/ton of pig.

For this purpose, the [Si]% in the molten pig iron×the hot metal ratio is set in a constant range. If the variation of the silicon [Si] in the molten pig iron is large, the above constant range is maintained by adjusting the hot metal ratio, but if the value is within ±10.0 outside the range there is no substantial problem even if a contant hot metal ratio is maintained and the variation of the blown-off phosphorus [P] content can be minimized. The quick lime is charged in a constant amount within a constant range and also its charging timing is maintained consistent. For example, as shown in Example 1, when the amount of quick lime to be added is set at (4.0±2) kg/ton of pig iron, namely in ±5% outside the preset constant range, the ratio of $CaO/SiO_2$ in the slag can be stabilized in the range of 3.3±0.3, and the variation of the blown-off [P] is minimized as shown in FIG. 3.

More preferably, the timing of adding the quick lime is made consistent so as to improve the reproductivity of the slag formation behaviour, and as shown in Example 1, the quick lime is added 50% at the beginning of the blowing, 25% each 4 minutes and 8 minutes after the beginning of the blowing. Also the consistent amount to be added and the consistent timing for addition of fluxes such as $CaF_2$, Fe-Mn ore and dolomite are important for rendering the slag formation behaviour in a consistent manner, and it is desirable their amounts to be added are maintained ±10% of the predetermined constant amounts.

2. Fe-Mn ore is added in an amount not less than 5 kg/ton of pig iron so as to increase the blown-off manganese [Mn] content as well as to promote an earlier slag formation.

The Fe-Mn ore is added for the purpose of increasing the effect of the constant blown-off carbon [C] content in the higher carbon zone and developing the earlier slag formation intended for removal of phosphorus.

Figure 4:
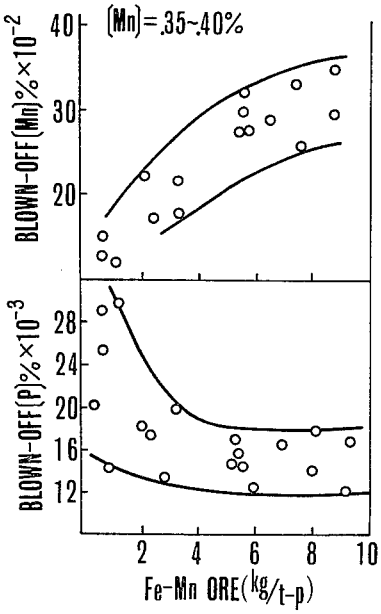
FIG. 4 shows the relation between the amount of charged Fe-Mn ore and the blown-off phosphorus [P] percent as well as the blown-off manganese [Mn] percent.

The present inventors conducted experiments using considerably different amounts of Fe-Mn ore for the above purposes, and the results are shown in FIG. 4.

It has been revealed by these results that when the amount of Fe-Mn ore added is small, less than 5 kg/ton of pig, the slag formation at the initial and middle stages is not enough and the resultant blown-off phosphorus [P] content is high due to shortness of dephosphorization of the slag and its variation is considerably large.

On the other hand, when the Fe-Mn ore is added in amounts not smaller than 5 kg/ton of pig, the resultant blown-off phosphorus [P] content can be stabilized within a range of from 0.012 to 0.018%, and the blown-off manganese [Mn] is also stabilized at 0.20% or higher. As clearly understood from the above, the addition of the Fe-Mn ore promotes, at the initial stage of blowing, conversion of the quick lime into slag due to the lowered melting point of the slag caused by the increased (MnO) content, and is effective for dephosphorization in a low heat temperature zone, and in the middle and finishing stages the ore is reduced to increase the manganese [Mn] content in the steel bath, thus contributing to stabilize the (FeO) content in the slag at a low level.

3. Constant blown-off carbon [C] content in a high carbon zone.

Figure 5:
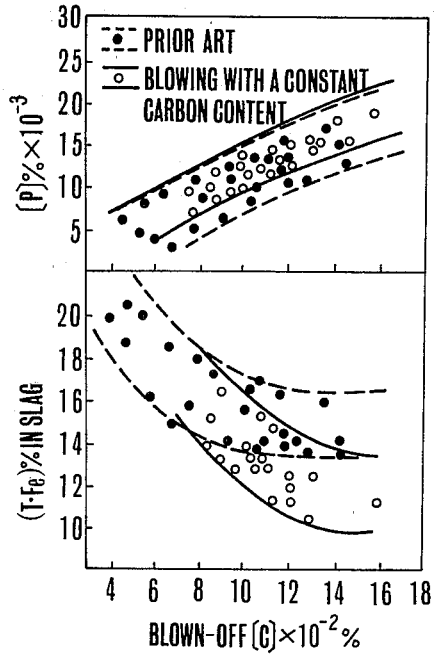
FIG. 5 shows the relation between the blown-off carbon [C] content in the steel and the blown-off total iron [T.Fe] content as well as the blown-off phosphorus [P] content in the steel.

In FIG. 5, the relation between the blown-off carbon [C] content and the blown-off total iron (T.Fe) content (%) as well as the blown-off phosphorus [P] content (%) in a blowing operation with a constant predetermined blown-off carbon [C] content is shown in comparison with that in a conventional process in which the blown-off carbon [C] content varies from charge to charge.

In the conventional process, too, as the blown-off carbon [C] content is increased, the resultant total iron (T.Fe)% in the slag lowers, but if the blowing off is continuously repeated several times in the high carbon zone, the total iron (T.Fe) in the slag formed by the previous charges and adhering to the furnace wall becomes low, so that the total iron (T.Fe) which is brought to subsequent charges decreases. And if the operation is continuously repeated several times in this way a multified effect can be produced so that it is possible to obtain a blown-off slag condition containing a total iron (T.Fe) content far lower than the level as conventionally obtained. Also the lowering effect of the total iron (T.Fe) in the slag by continuously maintaining the constant carbon [C] level is remarkably developed in the zone of the blown-off [C]=0.09%. Although the lowering effect of the total iron (T.Fe) content in the slag and the increasing effect of the blown-off manganese [Mn] content are enhanced as the blown-off carbon [C] content is set at a higher carbon zone, the blown-off carbon [C] content over 0.15% makes it difficult to consistently maintain the total iron (T.Fe) level in the slag required for dephosphorization, and it is not advantageous because it tends to increase the decarburization work in the secondary refining step. However, in the case of steel grades which permit an upper limit of the blown-off phosphorus [P] content beyond 0.020% or in the case where the phosphorus content in the molten pig iron can be lowered to 0.100% or less by a preliminary dephosphorization, the upper limit 0.15% of the blown-off carbon [C] content can be further extended to a higher carbon zone.

Figure 6:
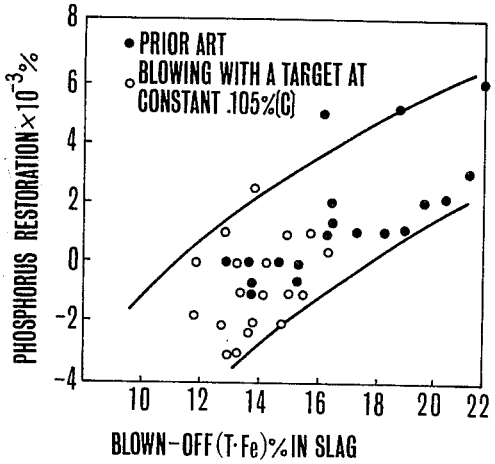
FIG. 6 shows the relation between the blown-off total iron (T.Fe) in the slag and the restoration of phosphorus content to the steel after the tapping in the case of a low-carbon Al-killed steel.
Figure 7:
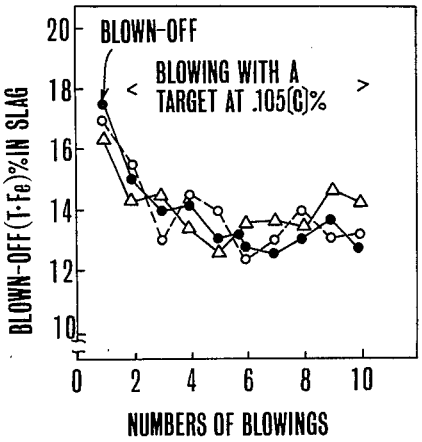
FIG. 7 shows the gradual lowering of the blown-off total iron (T.Fe) content in the slag when the refining with a constant high blown-off carbon [C] content is continuously performed.

Even with the formation of slag having such a low total iron (T.Fe) content, the resultant blown-off phosphorus [P] content is as low as conventionally achieved due to the dephosphorization promoting measure as mentioned above, so that a higher average blown-off phosphorus [P] percent can be aimed to corresponding to the decrease in the variation of the blown-off phosphorus [P] contents. Further, the slag formed in this way has a high viscosity so that the restoration of phosphorus to the steel after the tapping is small as compared with the conventional process, as clearly shown in FIG. 6, and there is produced no adverse influence on the phosphorus content in the final product if the blown-off phosphorus [P] level is increased. The lowering effect of the total iron (T.Fe) in the slag by the constant blown-off carbon [C] content can be increased by continuously maintaining it through several charges, as shown in FIG. 7, at least four charges. FIG. 7 shows the results obtained by blowing one charge with a blowing end point at a low carbon content of 0.06% [C] and then continuously blowing the subsequent charges each with a blowing end point at 0.105% [C]. As clearly shown by the results, the blown-off total iron (T.Fe) content in the slag lowers only gradually and about four charges are required before it is stabilized at a lower level. This may be attributed to the fact that parts of the slags formed by the previous charges remain adhering to the furnace wall and are stripped therefrom and introduced into the slag near the blowing end points of the subsequent charges. However, if the mixing condition of the charge materials and the blowing-off condition are maintained constant through blowing of several charges, factors, such as the viscosity, composition and remaining amount of the slags formed by preceding charges can be maintained constant so that the reproductivity of the dephosphorization and decarburization conditions can be improved.

4. Constant blowing-off temperature at a low level.

When a constant blown-off temperature is maintained in addition to the constant blown-off carbon [C] content, the converter operation can be further patterned with less variation in the blown-off composition and temperature. The stabilization of the blown-off conditions obtained in this way leads to improvement in the simultaneous achievement of the desired [C] content and temperature and to a remarkable lowering of the reblowing ratio and leads to a consistent interval time between individual tappings of the converter. Further the consistent blown-off temperature provides a constant furnace temperature and contributes to permit the patterning of the rotation of the molten steel vessel, thus reducing the lowering and variation in the ladle temperature, so that the tapping temperature can be set constantly near the lower limit of the conventional variation range. Thereby the refining temperature in the converter can be lowered so that the dephosphorization can be promoted further, thus reducing the necessity of reblowing due to the deviation of phosphorus content, and hence further improvement in the hitting ratio of both the desired blown-off carbon [C] content and temperature. In this case, the blown-off temperature to be set varies depending on the tapping capacity per charge, the steel grades to be treated, the seconary refining, the casting method adopted by individual steel making shops, but it is desirable to stop the blowing with a target on a constant temperature within the range of from 1600° to 1640° C., because if the temperature is set below 1600° C., the temperature deviation problem after the tapping remarkably increases, and on the other hand, the blown-off temperature beyond 1640° C. is often practically unnecessary, and if a higher blown-off temperature is required for treating a very small amount of certain steel grades, it is very often more advantageous in the over-all economy to heat the molten steel in the secondary refining furnace.

5. Direct connection to a secondary refining furnace having carburization and decarburization means, and more preferably having heating and cooling means.

According to the converter operation in the present invention, since the blown-off carbon [C] content is substantially constant, the carbon adjustment to the desired carbon content in the final product must be performed in the secondary refining furnace. As the secondary refining furnace for this purpose, a vacuum treating furnace, such as RH, DH and VOD, may be used, or agitation of molten steel by inert gas injection with sealing from air can be employed, but in any way decarburization function by oxygen blowing and carburization function by addition of carbonaceous material must be provided.

Further, if the secondary refining furnace is provided with heating function, such as by oxidation heat generation caused by the oxygen blowing and electric heating and cooling function, such as by addition of coolant, it is possible to achieve a consistent blown-off temperature, which can enhance the over-all efficiency and economy. Description of Preferred Embodiment:

Some examples of the present invention are shown below in the Table in comparison with the conventional arts.

TABLE

| | | Example of the Present Invention Blowing-off constant in high carbon zone | Example 2 of the Present Invention Blowing-off constant high carbon zone & at a constant temp. | Conventional Art |
|---|---|---|---|---|
| Number of Charges | | 5600 | 3200 | 6500 |
| Converter | Hot metal ratio (%) | 90–100 | 90–100 | 84–100 |
| | [Si]% in molten pig iron | 0.25–0.50 | 0.25–0.50 | 0.25–0.60 |
| | Hot metal ratio × [Si]% in molten pig iron | 25–45 | 25–45 | 21–60 |
| | Quick lime:kg/ton-pig | 38–42 | 38–42 | 36–44 |
| | Iron ore:kg/ton-pig | 40–60 | 50–70 | 20–70 |
| | Fe—Mn ore:kg/ton-pig | 8.0 | 8.0 | 2.2–6.5 |
| | Blowing amount Nm/ton-pig | 43–46 | 41–45 | 44–50 |
| | Blown-off [C]% | 0.105 ($\sigma$ = 0.015) | 0.102 ($\sigma$ = 0.012) | 0.072 ($\sigma$ = 0.029) |
| | Blown-off [Mn]% | 0.26 ($\sigma$ = 0.025) | 0.27 ($\sigma$ = 0.021) | 0.16 ($\sigma$ = 0.038) |
| | Blown-off [P]% | 0.0156 ($\sigma$ = 0.0021) | 0.0161 ($\sigma$ = 0.0018) | 0.0134 ($\sigma$ = 0.0034) |
| | Blown-off (T.Fe)% in slag | 13.6 ($\sigma$ = 2.09) | 13.1 ($\sigma$ = 1.98) | 18.1 ($\sigma$ = 2.87) |
| | Blown-off (CaO)/($SiO_2$) in slag | 3.32 ($\sigma$ = 0.15) | 3.36 ($\sigma$ = 0.14) | 3.53 ($\sigma$ = 0.24) |
| | Blown-off Temp. (°C.) | 1636 ($\sigma$ = 13) | 1620 ($\sigma$ = 8) | 1640 ($\sigma$ = 15) |
| | Hitting ratio of both [C] Temperature (%) | 87 | 94 | 74 |
| | Re-blowing (%) | 3.8 | 1.8 | 13.5 |
| RH | Treating Time (min.) | 17.3 | 19.5 | 14.5 |
| | Number of charges blown | 3615 | 2911 | — |
| | Number of charges carburized | 815 | 513 | 985 |
| Result | Yield of refined steel by the converter | 95.85 | 96.05 | 95.01 |
| | Life of converter refractory life (Number of heats) | 1512 | 2010 | 1124 |
| | Life of ladle refractory life (Number of heats) | 85 | 97 | 69 |
| | Required amount of Al kg/ton of refined steel | 0.98 | 1.11 | 1.10 |

In each of the examples shown in the table, 350 ton molten steel per charge was oxygen-blown in a converter under the conditions set forth in the table, adjusted in a vacuum composition in a vacuum degassing treatment in accordance with final applications, and continuously cast into slabs.

In Example 1, only the blown-off carbon [C] content was set constantly at 0.105%, and in Example 2, the blown-off temperature in addition to the carbon [C] was set constantly at 1620° C.

As clearly illustrated by the results obtained in Examples 1 and 2, the present invention is effective to stabilize the refining function of a converter at a high level, and particularly effective to improve and stabilize the dephosphorization function of the converter, so that it is possible to achieve a blow-off phosphorus [P] percent which well satisfies the standard phosphorus content requirement in the final product even when a low-FeO slag composition hitherto regarded to be unfavourable for dephosphorization is used. Therefore, the substantial advantages of the present invention can be produced by lowering the (FeO) content in the slag, and are remarkable in the following aspects.

(1) Improvement of yield of refined steel.

The yield is improved at least by 0.3% over the conventional art.

(2) Lowering of alloying elements required per unit ton of refined steel.

Since the blown-off manganese [Mn] content can be stabilized at 0.20% or higher, the amount of Fe-Mn required per unit tone of refined steel can be considerably reduced. Also as the resultant slag is low in FeO and has a high viscosity, the total FeO discharged at the time of tapping is small, so that the yield of alloying elements, such as Al and Si, which are added during the tapping or in the secondary refining furnace, is considerably improved.

(3) Improvement of refractory life in the converter and ladle.

As the resultant slag is high viscous, the errosion of the refractories by the slag is less so that the refractory life is improved by about 30%. Further, the constant low-temperature blown-off condition is additionally maintained, the refractory life is improved remarkably by 50 to 100%.

(4) Improvement of capacity.

As the blow end-points can be stabilized, the variation in the internal between individual tappings is reduced. This will produce an advantage to stabilize the multi-continuous casting operation when the process of the present invention is connected to a continuous casting process, for example.

(5) Improvement of the quality of final products.

As stated above, the total FeO amount discharged out of the ladle is less and the reactivity of the slag with the molten steel in the ladle is low, so that the non-metallic inclusions can be maintained lower, hence considerably improving the surface and internal qualities of the final product over the conventional arts.

What is claimed is:

1. A process for refining molten pig iron and steel, which comprises successively treating each of at least four charges with oxygen-blowing in a converter and stopping the oxygen-blowing at a blown-off carbon [C] content ranging from 0.09 to 0.15%, tapping the resultant molten steel from the converter, and subjecting the molten steel tapped from the converter to a secondary refinement to obtain a desired carbon content.

2. A process according to claim 1, in which the secondary refinement comprises at least one of carburization and decarburization.

3. A process according to claim 1, in which the oxygen-blowing is stopped at a temperature ranging from 1600° to 1640° C., and the temperature of the molten steel tapped from the converter is adjusted to a desired casting temperature.

4. A process according to any of claims 1 to 3, in which the variation of ([Si]% in the molten pig iron)×(hot metal ratio) is maintained ±10, the variation of the amount auxiliary materials is controlled ±5%, and the charging of the auxiliary material is made at substantially same stage for each of blowing.

5. A process according to any of claims 1 to 4, in which at least 5 kg/ton of pig of Fe-Mn ore is added during the blowing.

6. A process according to any of the preceding claims 1 to 5, in which the secondary refinement is done by oxygen blowing in a vacuum degassing vessel.

7. A process according to claim 6, in which the vacuum degassing vessel is RH degassing vessel.

8. A process according to claim 1, in which each of said charges consists essentially of quick lime, iron ore and iron-manganese ore.

* * * * *